US007533503B2

(12) United States Patent
Wang

(10) Patent No.: US 7,533,503 B2
(45) Date of Patent: May 19, 2009

(54) KNOCKDOWN DOORFRAME FOR ADJUSTABLY ACCOMMODATING WALL THICKNESS AND BUILDING METHOD THEREOF

(76) Inventor: Guo-Chi Wang, 5Fl., No. 19, Lane 85, King-Hua Street, Panchiao, Taipei Hsien (TW)

( * ) Notice: Subject to any disclaimer, the term of this patent is extended or adjusted under 35 U.S.C. 154(b) by 347 days.

(21) Appl. No.: 11/481,277

(22) Filed: Jul. 6, 2006

(65) Prior Publication Data

US 2007/0022699 A1 Feb. 1, 2007

(30) Foreign Application Priority Data

Jul. 6, 2005 (TW) ..... 94122898 A

(51) Int. Cl.
*E06B 1/20* (2006.01)

(52) U.S. Cl. ..... 52/217; 52/213; 52/204.1; 52/211; 49/505; 49/504

(58) Field of Classification Search ..... 52/204.54, 52/204.1, 204.2, 210, 217, 213, 212, 215, 52/585.1, 207; 49/505; 72/149
See application file for complete search history.

(56) References Cited

U.S. PATENT DOCUMENTS 3,545,135 A * 12/1970 Lieber ..... 49/505
4,531,337 A * 7/1985 Holdiman ..... 52/217
4,541,212 A * 9/1985 MacDonald ..... 52/217
4,589,229 A * 5/1986 Warren ..... 49/505
5,070,651 A * 12/1991 Jeter ..... 49/505
5,187,898 A * 2/1993 McKann ..... 49/505
5,233,802 A * 8/1993 Rogers ..... 52/212
5,365,708 A * 11/1994 Winston ..... 52/212
5,412,909 A * 5/1995 Wu ..... 49/505
6,158,179 A * 12/2000 Ackerly et al. ..... 52/220.7
6,167,663 B1 * 1/2001 Nakamoto et al. ..... 52/217
6,192,638 B1 * 2/2001 Wang ..... 52/213
6,308,476 B1 * 10/2001 Nakamoto et al. ..... 52/217
6,438,912 B1 * 8/2002 Avent ..... 52/207
6,557,309 B1 * 5/2003 Johnson ..... 52/210
7,340,866 B1 * 3/2008 Smith ..... 52/204.54
7,380,430 B1 * 6/2008 Rusch ..... 72/149
2002/0014050 A1 * 2/2002 Van Der Heijden ..... 52/585.1

* cited by examiner

*Primary Examiner*—Richard E Chilcot, Jr.
*Assistant Examiner*—Alp Akbasli

(57) ABSTRACT

A knockdown doorframe includes: a pair or jambs respectively secured to a right and a left vertical side wall of a doorway, each jamb having an adjustable covering plate adjustably shielding a side portion of the jamb with the wall; and a lintel horizontally secured to a top portion of each jamb adjacent to a horizontal top wall of the doorway and having an adjustable horizontal covering plate adjustably shielding an upper portion of the lintel and the horizontal top wall, whereby upon a sliding or telescopic movement of each covering plate in each jamb or in the lintel, the covering plate may adjustably well shield the jamb or lintel with the wall having variable wall thickness for security and ornamental purposes.

1 Claim, 6 Drawing Sheets

KNOCKDOWN DOORFRAME FOR ADJUSTABLY ACCOMMODATING WALL THICKNESS AND BUILDING METHOD THEREOF

BACKGROUND OF THE INVENTION

This application is an improvement based upon the prior art of U.S. Pat. No. 6,192,638 also invented by the same inventor of this application.

Such a prior art of knockdown doorframe includes: a pair of jambs respectively secured on a right and left vertical side wall of a door entrance or doorway by means of brackets longitudinally pre-fixed on the right and left vertical side walls, each jamb having a waterproof pad cushioned on a bottom of the jamb, a lintel horizontally secured on the top portion of each jamb adjacent to a horizontal top wall of the doorway to form an inversed U-shaped doorframe, and each jamb and lintel having a covering plate covered thereon for shielding an aperture between the doorframe and the wall of the doorway for decorative purpose.

However, such a prior art can not be adjustable for accommodating a wall having variable thickness in many construction sites.

The present inventor therefore invented the present adjustable knockdown doorframe suitable for variable wall thickness.

SUMMARY OF THE INVENTION

The object of the present invention is to provide a knockdown doorframe including: a pair or jambs respectively secured to a right and a left vertical side wall of a doorway, each jamb having an adjustable covering plate adjustably shielding a side portion of the jamb with the wall; and a lintel horizontally secured to a top portion of each jamb adjacent to a horizontal top wall of the doorway and having an adjustable horizontal covering plate adjustably shielding an upper portion of the lintel and the horizontal top wall, whereby upon a sliding or telescopic movement of each covering plate in each jamb or lintel, the covering plate may adjustably well shield the jamb or lintel with the wall having variable wall thickness for security and ornamental purposes.

DETAILED DESCRIPTION

Figure 1:
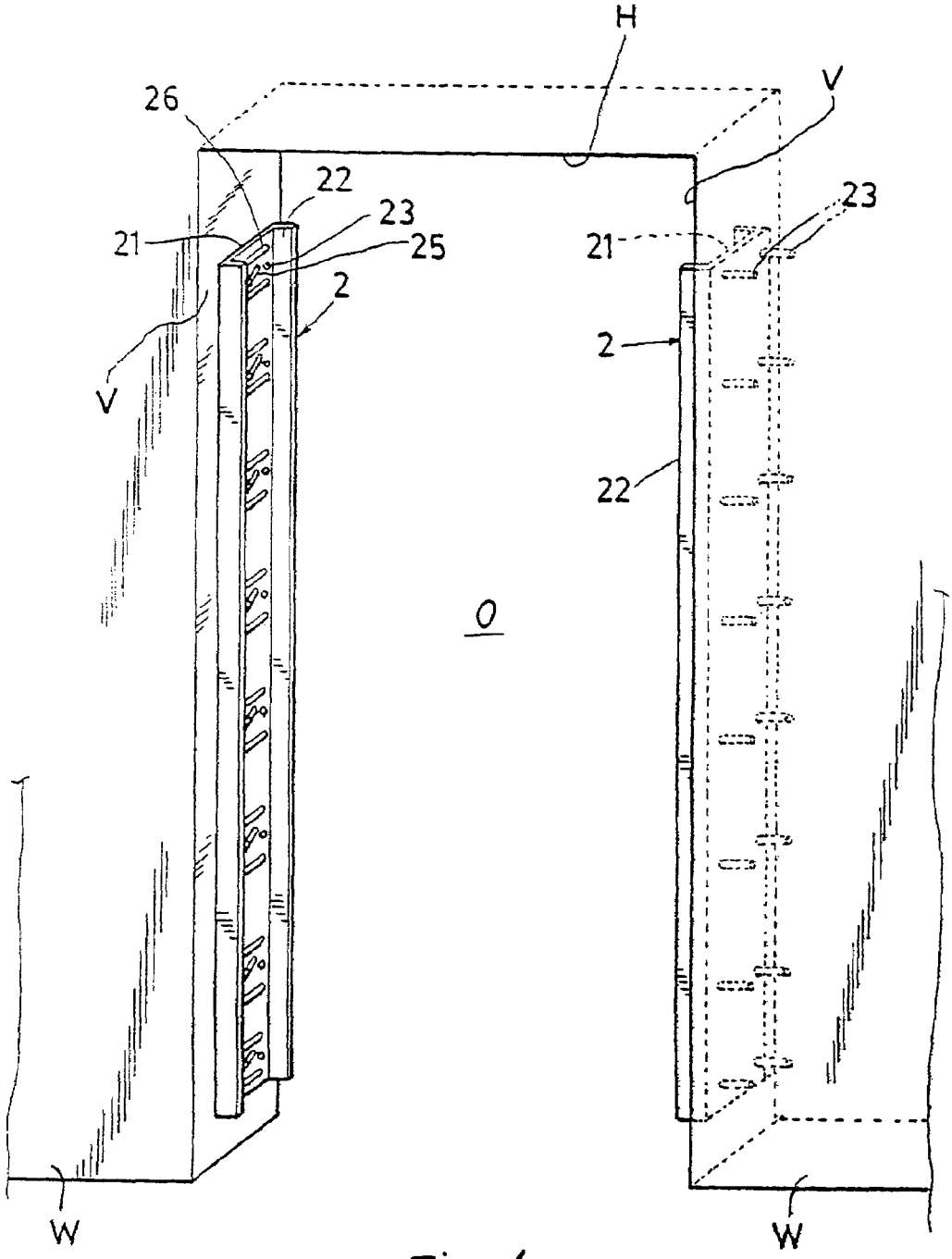
FIG. 1 is an illustration showing a pair of brackets secured on two vertical side walls of a doorway in accordance with the present invention.
Figure 2:
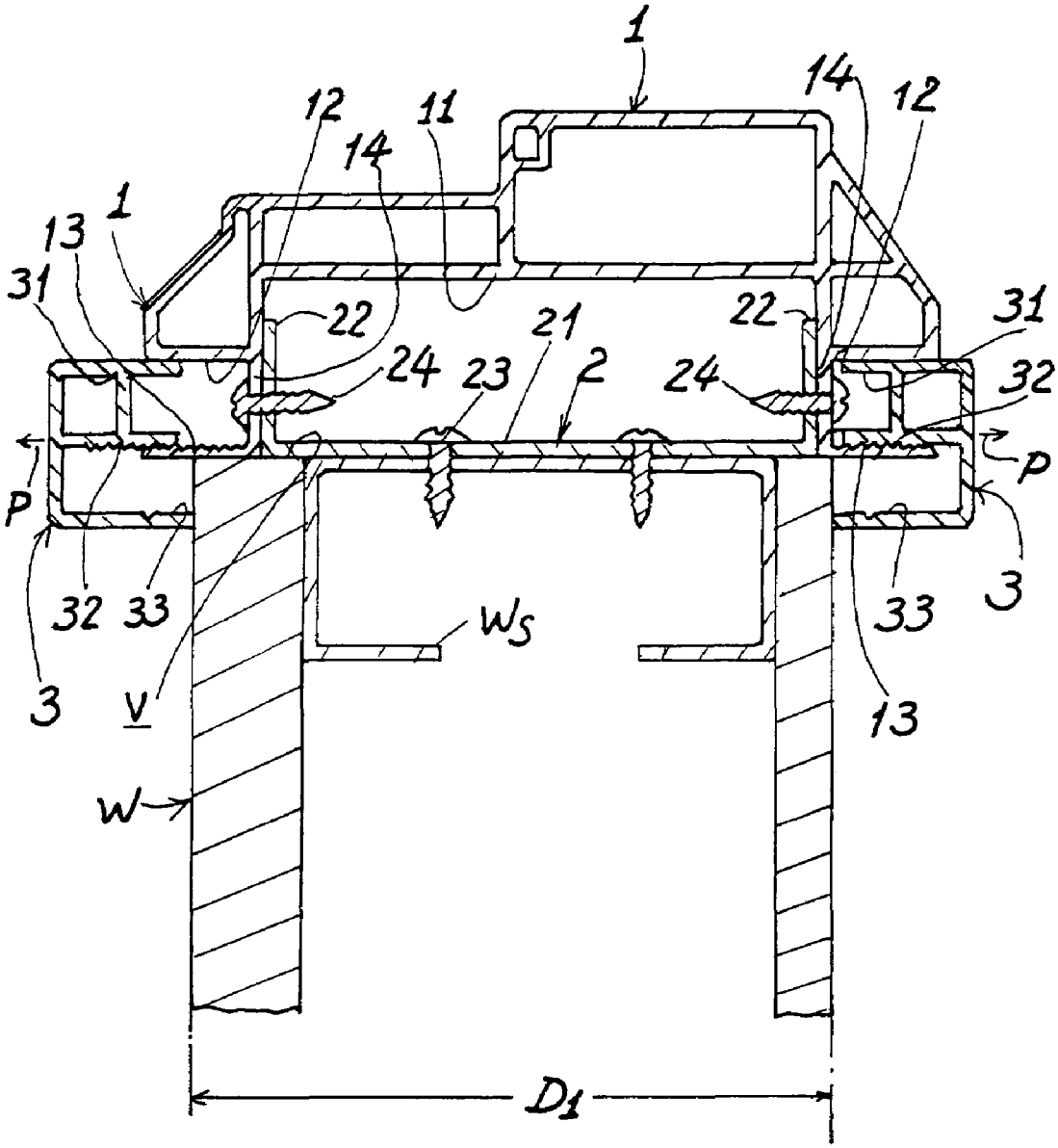
FIG. 2 is a cross sectional drawing of the present invention showing the jamb secured on a wall as covered by the adjustable covering plate of the present invention.
Figures 7, 8:
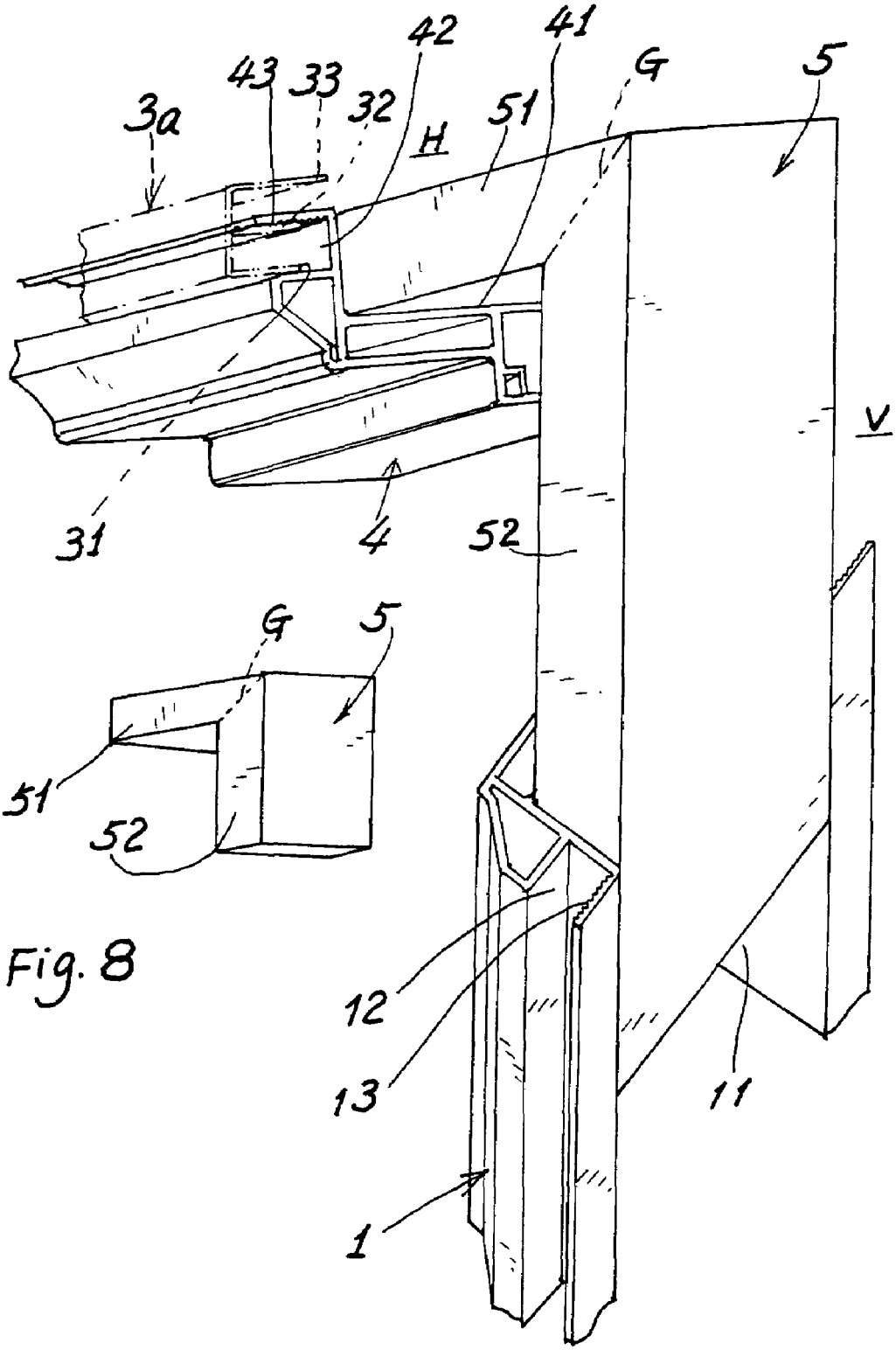
FIG. 7 is a partial perspective view of the lintel as coupled with the jamb by a coupling member in accordance with the present invention.
FIG. 8 shows the coupling member as shown in FIG. 7.

As shown in FIGS. 2, 1 and 8, the present invention comprises: a pair of jambs 1 respectively fixed on a left and a right vertical side wall V of a doorway O of a wall W by means of a pair of brackets 2 pre-fixed on the side walls V of the wall W; and a lintel 4 horizontally fixed on a top portion of each jamb 1 adjacent to a horizontal top wall H of the doorway to form a doorframe.

Each jamb 1 incorporates a pair of adjustable covering plates 3 for shielding a pair of side portions of the jamb 1 with the wall W for security and ornamental purposes.

The lintel 4 as horizontally secured between the pair of jambs 1 also incorporates an adjustable horizontal covering plate 3*a* for shielding an upper portion of the lintel 4 with the horizontal top wall H of the doorway O.

Each jamb 1 includes: a recess 11 longitudinally recessed in a back portion of the jamb 1 to be engageable with each bracket 2 as pre-fixed on the vertical side wall V of the wall W, two grooves 12 respectively formed in opposite side portions of the jamb 1 to be respectively engaged with two adjustable covering plates 3, 3 as shown in FIG. 2, each groove 12 having a toothed portion 13 formed in an inner portion of the groove 12 adjacent to the wall W, and a groove bottom portion 14 for fixing a bolt or screw 24 through the groove bottom portion 14 for securing the jamb 1 to the bracket 2.

The toothed portion 13 in the groove 12 of the jamb 1 may be formed as saw-toothed portion or ratchet teeth in the inner portion of the groove 12, not limited in the present invention.

Each jamb 1, lintel 4 and adjustable covering plate 3 may be formed by extrusion molding process or other molding processes or processing methods. The materials for making the jamb 1, lintel 4 and covering plate 3 may be made of plastic, aluminum alloy or any other suitable materials. The jamb 1, lintel 4 and covering plate 3 may be formed as wooden surface on a plastic core or substrate. However, the materials and methods for making the elements of the present invention are not limited.

Each bracket 2 may be formed as a U-shaped bracket made of steel or metal alloys; or formed as a rectangular block made of wooden or other suitable materials to be pre-fixed or secured on the wall or in order for securing the jamb 1 on the bracket 2.

The bracket 2 formed as U-shape as shown in FIGS. 1 and 2 includes: a base 21 fixed on the vertical side wall V by bolts or screws 23, and a pair of extensions 22 protruding outwardly from opposite ends of the base 21 to be secured with two groove bottoms 14, 14 of the jamb 1 to secure the jamb 1 on the wall W.

Since the wall W may be a partition wall made of light steel or metal alloy, a steel frame Ws is formed on the vertical side wall V of the wall W, adapted to be well secured with the U-shaped bracket 2 by bolts 23 as shown in FIG. 2.

Each bracket 2 may be pre-cut with a plurality of elongate slot, either horizontally shaped as numeral 26, or inclined shaped as numeral 25 for slidably passing the bolt 23 through the slot 26, 25 for an adjustable fixation of the bracket 2 on the vertical side wall V of the wall W.

Each adjustable covering plate 3 includes: an engaging member 31 telescopically engaged with the groove 12 as formed in a side portion of the jamb 1, and a trimming member 33 integrally linked with the engaging member 31 and having a free end portion of the trimming member 31 contacted, touched, or tightly limited on a wall surface of the wall W for shielding the aperture between the jamb 1 and the wall W for security and ornamental purposes.

The engaging member 31 is formed with an inside toothed portion 32 therein to be engaged with the toothed portion 13 formed in the groove 12 of the jamb 1, with the engaging member 31 of the covering plate 3 engaged with the groove 12 of the jamb 1 for concealing the bolt 24 which will not be revealed to or removed by an intruder once the covering plate 3 has covered the groove 12 of the jamb 1 and the wall W, leaving no aperture or space for removing the jamb 1. The relevant parts of the covering plate 3 may also be coated with adhesive or sealant to firmly bond the covering plate 3 with the jamb 1 which has been firmly secured to the wall W.

Since the door frame of the present invention is generally provided for interior partition wall within a house, its security factor may not be considered so seriously.

Since the jamb 1 or the covering plate 3 is formed by extrusion molding process or is extruded to contain void or hollow portion therein, it is so light and inexpensive for saving material and cost.

Since the engaging member 31 of the covering plate 3 is telescopically or slidably engaged with the groove 12 in the jamb 1, the present invention may therefore be suitable for adjustably accommodating a wall having variable thickness. For example, as shown in FIG. 2, a thicker wall W having a thickness D1 may be well shielded by outwardly pulling (P) the covering plate 3 until a complete covering of the jamb and the wall; while a narrow thickness D2 of the wall W as shown in FIG. 3, the covering plate 3 may be pushed (P1) inwardly to allow the trimming member 33 of the covering plate 3 to well shield any aperture between the wall W and the jamb 1.

Figure 3:
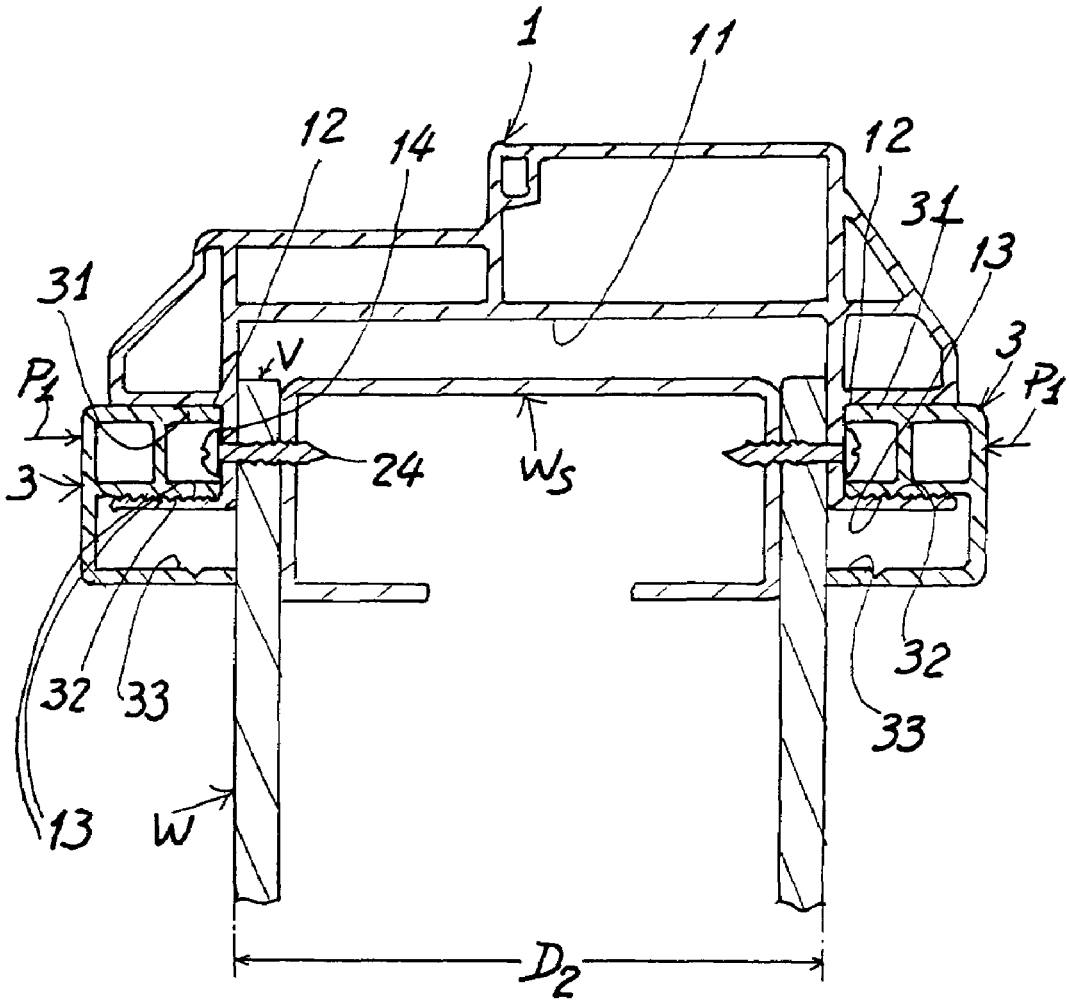
FIG. 3 is a cross sectional drawing of the present invention for an example having a wall thickness equal to a width of a recess as recessed in the jamb.

As shown in FIG. 3, the thickness D2 of the wall W is generally equal to the width of the recess 11 formed in the jamb 1.

Figure 4:
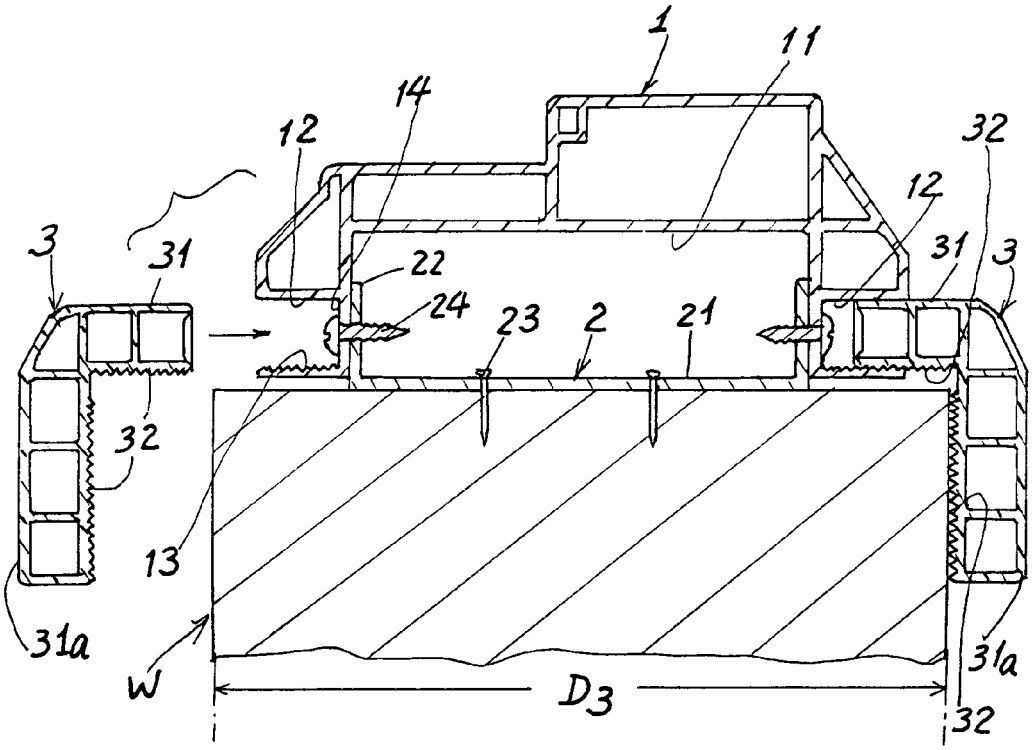
FIG. 4 is a cross sectional drawing of another preferred embodiment of the present invention adapted for wider wall thickness.
Figure 5:
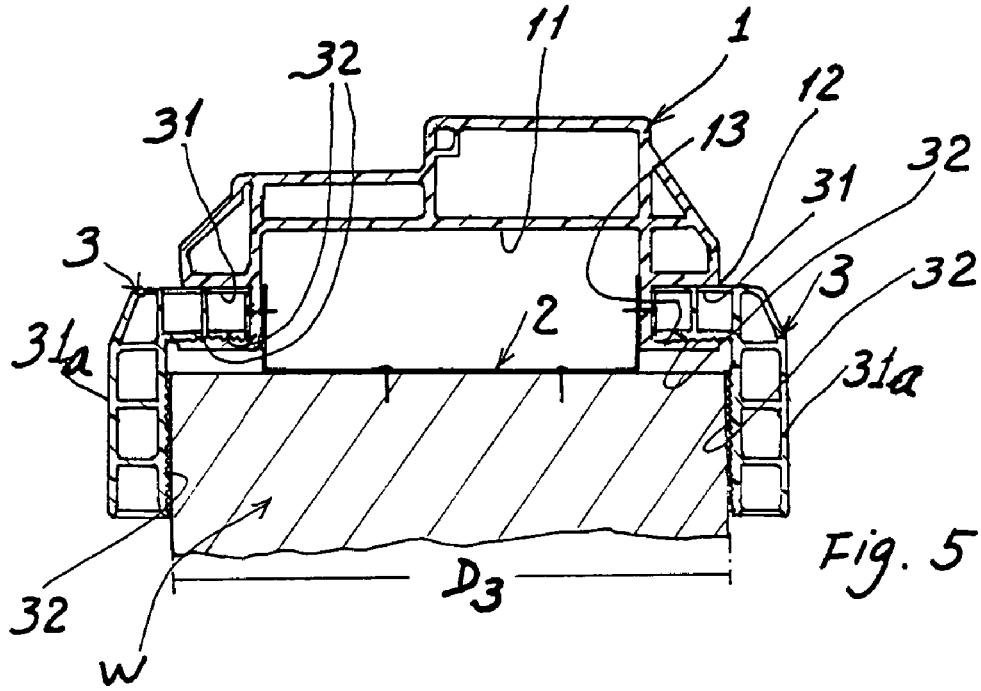
FIG. 5 is an illustration showing the fixation or assembly of the elements of the present invention as shown in FIG. 4.
Figure 6:
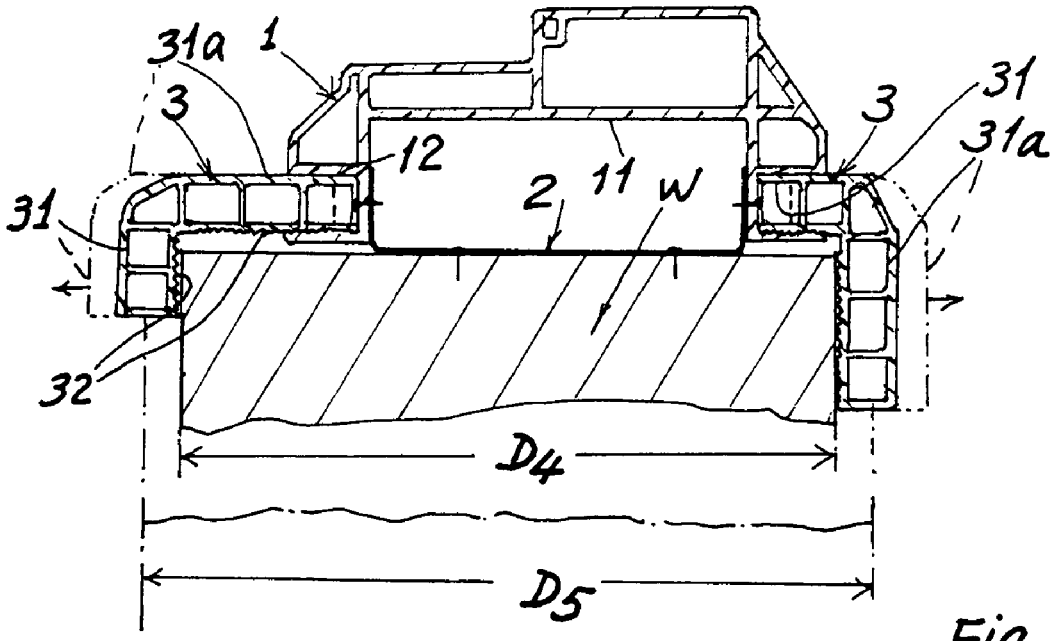
FIG. 6 shows a modification from that as shown in FIG. 5.

For those walls having wider thickness D3, D4 as shown in FIGS. 4~6, another preferred embodiment of the adjustable covering plate 3 is disclosed and will be described hereinafter.

The adjustable covering plate 3 includes a short engaging member 31 and a long engaging member 31*a* integrally formed with the short engaging member 31 to be a L shape, either short engaging member 31 or long engaging member 31*a* having a toothed portion 32 formed on an inner portion of each engaging member 31 or 31*a* to be alternatively engaged with the inside toothed portion 13 formed in the groove 12 of the jamb 1, whereby when it is provided for accommodating a wall having a narrow thickness D3 as shown in FIGS. 4 and 5, the short engaging member 31 is engaged with the groove 12 of the jamb 1; and whereby when it is provided for accommodating a wall having a wide thickness D4 as shown in FIG. 6, the long engaging member 31*a* is then engaged with the groove 12 of the jamb 1.

Accordingly, the adjustable covering plate 3 having the short engaging member 31 and the long engaging member 31*a* may be alternatively selected to be used for a narrower or a wider wall having varied thickness.

Still, each engaging member 31 or 31*a* may be telescopically engaged with the groove 12 in the jamb 1, such as shown in dotted line in FIG. 6, for adjustably accommodating a wider wall of thickness D5.

So, the present invention may provide a well adjustable doorframe for accommodating wall with varied thickness. The jamb 1 is formed by molding or extrusion process to be uniform size. The adjustable covering plates 3 may be telescopically engaged with the grooves 12 in the jamb 1 for adjusting the covering width or distance in between the two covering plates 3, 3 disposed on the jamb 1, like a "vise" (jamb) having a pair of "jaws" (covering plates) for adjustably clamping the wall having varied thickness.

The above-mentioned short engaging member 31 may be perpendicular to the long engaging member 31*a*. The two engaging members 31, 31*a* may define an angle therebetween.

As shown in FIGS. 7 and 8, the lintel 4 is horizontally coupled in between the two jambs 1, 1 by a pair of coupling members 5, 5. The lintel 4 may also be secured to a bracket (not shown) fixed on the horizontal top wall H.

Each coupling member 5 includes a horizontal tenon 51 engaged with a recess 41 as formed in the lintel 4, and a vertical tenon 52 engaged with a recess 11 formed in the jamb 1, so that the coupling member 5 may couple the lintel 4 with each jamb 1.

Naturally, an adjustable horizontal covering plate 3*a* (dotted line shown in. FIG. 7) may be provided for shielding an aperture between the lintel 4 and a horizontal top wall H of the doorway of the wall W.

The horizontal covering plate 3*a* includes an engaging member 31 engaged with a lintel groove 42, and a trimming member 33 contacted with an upper wall surface adjacent to the horizontal top wall H.

Also, the lintel 4 may be formed with lintel toothed portion 43 to be engaged with the toothed portion 32 formed in the horizontal covering plate 3*a* as shown in FIG. 7.

For illustration purpose, the lintel 4 and the jamb 1 are partially cut away as shown in FIG. 7. Substantially, the lintel 4 and the jamb 1 may be respectively formed with an angled end portion (45 degrees) to be diagonally joined with each other to be projectively aligned with the diagonal line G as inferentially formed on the coupling member 5 as shown in FIGS. 7 and 8.

The method for building the doorframe of the present invention may comprise the following steps:

1. Fixing the pair of jambs 1 on the opposite vertical side walls of the doorway of the wall, and securing the lintel 4 horizontally on the top portions of the pair of jambs contiguous to the horizontal top wall of the doorway; and
2. Telescopically engaging an adjustable covering plate 3 in a side portion of each said jamb 1 for shielding an aperture between said vertical side wall V and the jamb 1; and telescopically engaging an adjustable horizontal covering plate in an upper portion of the lintel 4 for shielding an aperture between said horizontal top wall H and the lintel 4.

The present invention may be modified without departing from the spirit and scope of the present invention.

I claim:

1. A knockdown doorframe comprising:

a pair of jambs respectively fixed on a left and a right vertical side wall of a doorway of a wall; and a lintel horizontally fixed on a top portion of each jamb adjacent to a horizontal top wall of the doorway to form a doorframe;

each said jamb having a pair of adjustable covering plates disposed on opposite side portions of said jamb, each said covering plate telescopically engaging in each said side portion of said jamb for adjustably covering each said side portion of said jamb on the wall; and said lintel as horizontally secured between the pair of jambs having an adjustable horizontal covering plate telescopically engaging in an upper portion of said lintel for adjustably covering said upper portion of the lintel on the horizontal top wall of the doorway; whereby upon telescopically engaging each said covering plate in each said jamb or in each said lintel, each said covering plate will shield an aperture between said wall having variable thickness with said jamb or with said lintel;

the improvement which comprises:

each said adjustable covering plate including a short engaging member and a long engaging member integrally formed with the short engaging member, either said short engaging member or said long engaging member having a toothed portion formed on an inner portion of each said engaging member to be alternatively engaged with an inside toothed portion formed in a groove of the jamb; said short engaging member being perpendicular to said long engaging member; whereby when it is provided for accommodating a wall having a narrow thickness, the short engaging member is engaged with the groove of the jamb; and whereby when it is provided for accommodating another wall having a wide thickness, the long engaging member is then engaged with the groove of the jamb.

* * * * *